US010317824B2

(12) United States Patent
Hiroi et al.

(10) Patent No.: US 10,317,824 B2
(45) Date of Patent: Jun. 11, 2019

(54) FIXING DEVICE AND IMAGE FORMING APPARATUS

(71) Applicants: Kiwako Hiroi, Gifu (JP); Kohichi Utsunomiya, Kanagawa (JP); Yuusuke Furuichi, Kanagawa (JP)

(72) Inventors: Kiwako Hiroi, Gifu (JP); Kohichi Utsunomiya, Kanagawa (JP); Yuusuke Furuichi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/004,832

(22) Filed: Jun. 11, 2018

(65) Prior Publication Data

US 2018/0356755 A1 Dec. 13, 2018

(30) Foreign Application Priority Data

Jun. 12, 2017 (JP) ..... 2017-115020

(51) Int. Cl.
*G03G 15/20* (2006.01)

(52) U.S. Cl.
CPC ..... *G03G 15/2032* (2013.01); *G03G 15/206* (2013.01); *G03G 2215/2009* (2013.01)

(58) Field of Classification Search
CPC ..... G03G 15/2032; G03G 15/206; G03G 2215/2009; G03G 2215/2025; G03G 2215/2035; G03G 2215/2041
See application file for complete search history.

(56) References Cited

U.S. PATENT DOCUMENTS

| | | | | |
|---|---|---|---|---|
| 10,082,755 | B1 * | 9/2018 | Takahashi | G03G 15/206 |
| 2012/0002997 | A1 | 1/2012 | Hiraoka et al. | |
| 2014/0294456 | A1 | 10/2014 | Ueno et al. | |
| 2014/0294461 | A1 | 10/2014 | Tokuda et al. | |
| 2015/0139705 | A1 | 5/2015 | Furuichi et al. | |

(Continued)

FOREIGN PATENT DOCUMENTS

| | | |
|---|---|---|
| JP | 2006-243033 | 9/2006 |
| JP | 2013-117576 | 6/2013 |

(Continued)

OTHER PUBLICATIONS

U.S. Appl. No. 15/841,383, filed Dec. 14, 2017 Jun Okamoto, et al.

*Primary Examiner* — Sophia S Chen
(74) *Attorney, Agent, or Firm* — Harness, Dickey & Pierce, P.L.C.

(57) ABSTRACT

A fixing device includes an endless belt, a pressure rotator that contacts the endless belt, a nip formation pad in the endless belt to form a fixing nip between the endless belt and the pressure rotator, a heater in the endless belt to heat the endless belt, a stay to support the nip formation pad, a contact-separation mechanism that presses the nip formation pad against the pressure rotator in a releasable manner, a holder movable between a nip formation position and a release position to support the stay, and an adjustment mechanism. The holder is provided with a slot to support the heater, and the adjustment mechanism makes a distance between the heater and the nip formation pad when the holder is at the nip formation position larger than a distance between the heater and the nip formation pad when the holder is at the release position.

16 Claims, 11 Drawing Sheets

(56) References Cited

U.S. PATENT DOCUMENTS

| | | | |
|---|---|---|---|
| 2015/0198920 | A1 | 7/2015 | Fukuhata et al. |
| 2015/0227097 | A1 | 8/2015 | Yamano et al. |
| 2015/0261147 | A1 | 9/2015 | Arai et al. |
| 2015/0261155 | A1 | 9/2015 | Yoshiura et al. |
| 2015/0261157 | A1 | 9/2015 | Yamano et al. |
| 2015/0268626 | A1 | 9/2015 | Saito et al. |
| 2016/0011548 | A1 | 1/2016 | Utsunomiya et al. |
| 2016/0011549 | A1 | 1/2016 | Utsunomiya et al. |
| 2016/0011550 | A1 | 1/2016 | Utsunomiya et al. |
| 2016/0033906 | A1 | 2/2016 | Ikebuchi et al. |
| 2016/0033911 | A1 | 2/2016 | Fukuhata et al. |
| 2016/0062286 | A1 | 3/2016 | Yoshiura et al. |
| 2016/0098000 | A1 | 4/2016 | Furuichi et al. |
| 2016/0187822 | A1 | 6/2016 | Fukuhata et al. |
| 2016/0221775 | A1 | 8/2016 | Yoshiura et al. |
| 2017/0097599 | A1 | 4/2017 | Fukuhata et al. |
| 2017/0102646 | A1 | 4/2017 | Ikebuchi et al. |
| 2017/0108807 | A1 | 4/2017 | Furuichi et al. |
| 2017/0115610 | A1 | 4/2017 | Yoshiura et al. |
| 2017/0131664 | A1 | 5/2017 | Utsunomiya et al. |
| 2017/0146933 | A1 | 5/2017 | Yamano et al. |
| 2017/0185019 | A1 | 6/2017 | Seo et al. |
| 2017/0343942 | A1 | 11/2017 | Okamoto et al. |

FOREIGN PATENT DOCUMENTS

| | | |
|---|---|---|
| JP | 2014-059589 | 4/2014 |
| JP | 2014-067068 | 4/2014 |
| JP | 2015-166888 | 9/2015 |

* cited by examiner

FIXING DEVICE AND IMAGE FORMING APPARATUS

CROSS-REFERENCE TO RELATED APPLICATION

This patent application is based on and claims priority pursuant to 35 U.S.C. § 119 to Japanese Patent Applications No. 2017-115020, filed on Jun. 12, 2017 in the Japanese Patent Office, the entire disclosure of which is hereby incorporated by reference herein.

BACKGROUND

Technical Field

The present disclosure relates to a fixing device and an image forming apparatus using the fixing device.

Background Art

Recently, in order to reduce energy consumption and shorten wait time, that is, warming-up time, many new fixing devices used in image forming apparatuses such as printers, copiers, and fax machines have a so-called on-demand type structure that directly heats a small heat-capacity endless film-like belt.

Such new fixing devices using a quick-start-up (QSU) method include a rotatable endless free belt, a heater that is disposed inside a loop formed by the free belt and which directly heats the free belt, an elastic roller that contacts an outer surface of the free belt, and a pad that is disposed inside the loop formed by the free belt and extends in a longitudinal direction of the elastic roller. The pad, which is also called a nip formation pad and which elastically deforms the elastic roller, serves to broaden a contact region between a sheet of recording media and the free belt, that is, a nip width, if the belt is a relatively narrow one.

The free belt and the pad situated inside the loop formed by the free belt are set at a predetermined position with respect to the elastic roller, which is fixed on a shaft driven to rotate, to press the elastic roller and form a fixing nip while printing and, after printing, to move to a release position separate from the belt, in which the free belt does not press the elastic roller to avoid compression set of the elastic roller.

It is to be noted here that, conventionally, the heater and the pad are fixed together on a holder that is supported by a side plate and from which the free belt is suspended because the heater needs to be disposed at a predetermined constant clearance with respect to the free belt and the pad when the free belt and the pad press against the elastic roller and form the fixing nip.

SUMMARY

This specification describes an improved fixing device and an image forming apparatus using the fixing device.

In one illustrative embodiment, the fixing device includes an endless belt, a pressure rotator that contacts an outer surface of the endless belt, a nip formation pad enclosed in a loop formed by the endless belt to form a fixing nip between the endless belt and the pressure rotator, a heater enclosed in the loop formed by the endless belt to heat the endless belt, a stay to support the nip formation pad, a contact-separation mechanism that presses the nip formation pad against the pressure rotator in a releasable manner, a holder disposed on the outer side in a width direction of the belt and movable between a nip formation position and a release position to limit movement of the endless belt in the width direction and support the stay, and an adjustment mechanism. The holder is provided with a slot to support the heater relatively movable with respect to the holder. The adjustment mechanism makes a distance between the heater and the nip formation pad when the holder is at the nip formation position larger than a distance between the heater and the nip formation pad when the holder is at the release position.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
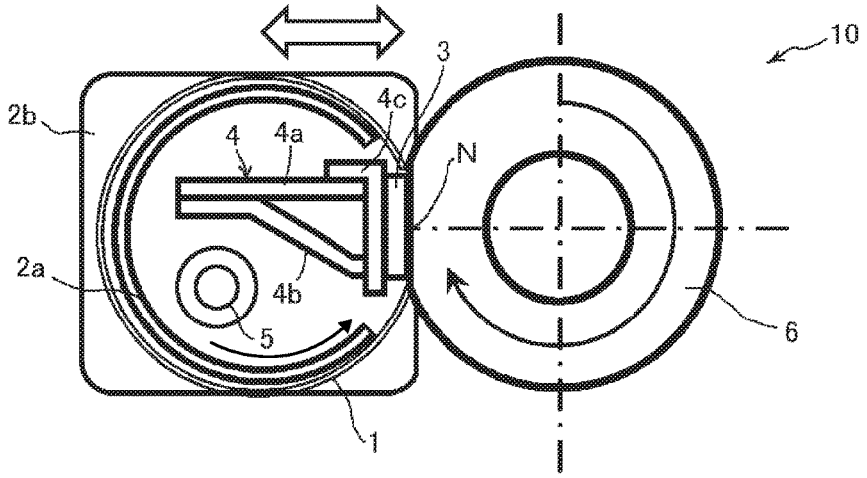
FIG. 1 is a schematic diagram illustrating a fixing device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

A description is provided of embodiments of the present disclosure below. As illustrated in FIG. 1, a fixing device 10 mainly includes a fixing belt 1, an elastic roller 6 serving as a pressure rotator, a heater 5 serving as a heat source to heat the fixing belt 1, a nip formation pad 3, a holder 2 to support the fixing belt 1 and the heater 5. Additionally, as a well-known structure, a temperature sensor is disposed near an outer surface of the fixing belt 1 to detect a fixing temperature, and a contact-separation mechanism 20 is disposed such that the nip formation pad 3 and the fixing belt 1 can press the elastic roller 6 in a releasable manner.

A detailed description is now given of a construction of the elastic roller 6. The elastic roller 6, having a diameter in a range of, for example, from 20 mm to 40 mm, is constructed of a hollow cored bar and an elastic layer coating the cored bar. The elastic layer is made of solid rubber such as silicone rubber or fluoro-rubber. A heater source such as a halogen heater may be inside the elastic roller 6. When the heat source is not inside the elastic roller 6, sponge rubber such as foamed silicone rubber with excellent thermal insulation may be used as the elastic layer. A thin release layer made of tetrafluoroethylene-perfluoroalkyl vinyl ether copolymer (PFA), polytetrafluoroethylene (PTFE), or the like may be disposed on a surface of the elastic layer to facilitate separation of a sheet from the elastic roller 6. An end of the elastic roller 6 mounts a driving gear as well known, and the elastic roller 6 is driven and rotated clockwise, that is in an arrow direction in FIG. 1.

A detailed description is now given of a construction of the fixing belt 1. The fixing belt 1 is a thin endless belt like a film, made to have a diameter, for example, from 15 mm to 120 mm (about 30 mm in the present embodiment), and driven and rotated counterclockwise, that is, an arrow direction in FIG. 1 in accordance with rotation of the elastic roller 6 by friction therebetween. The fixing belt 1 is constructed of a base layer constituting the inner circumferential surface that is the surface contacting and sliding the nip formation pad 3, an elastic layer coating the base layer, and a release layer coating the elastic layer, which produce a total thickness of the fixing belt 1 not greater than 500 μm.

The base layer of the fixing belt 1 has a thickness of, e.g., about 30 μm to about 100 μm, and is made of a metal material, such as nickel or stainless steel, or a resin material such as polyimide. The elastic layer of the fixing belt 1 has a thickness of, e.g., about 100 μm to about 300 μm, and is made of a rubber material such as silicon rubber, silicon rubber foam, or fluoro rubber. The elastic layer absorbs slight surface asperities of the fixing belt 1 at the fixing nip, facilitating even heat conduction from the fixing belt 1 to a toner image on the sheet and thereby suppressing formation of an orange peel image on the sheet. The release layer of the fixing belt 1 may be made of PFA, PTFE, polyimide (PI), polyamide imide (PAI), polyether imide (PEI), polyether sulfide (PES), polyether ether ketone (PEEK), or the like.

A detailed description is now given of a construction of the heater 5. The heater 5 is situated inside the loop formed by the fixing belt 1 and extends in a width direction of the fixing belt 1. Radiant heat generated by electric power controlled and output from a power source in a printer body directly heats the inner surface of the fixing belt 1. A halogen heater, a carbon heater, or the like may be used as the heater 5. FIG. 1 illustrates one heater as the heater 5, but the heater 5 may be two or more heaters having different light distributions in the longitudinal direction thereof. Each of the two or more heaters may heat each of areas on the fixing belt 1 divided in the width direction of the fixing belt 1 to heat an area corresponding to a small size sheet and avoid heating an unnecessary area when the small size sheet is printed. Electric power supplied to the heater 5 is controlled based on the surface temperature of the fixing belt 1 detected by a temperature sensor such as a thermistor facing the surface of the fixing belt 1 as well known. Such control of the electric power supplied to the heater 5 enables the temperature of the fixing belt 1, that is, the fixing temperature to keep in a desired temperature range.

A detailed description is now given of a configuration of the nip formation pad 3. The nip formation pad 3, which is also called a fixing pad, is situated inside the loop formed by the fixing belt 1 and extends in the width direction of the fixing belt 1. The nip formation pad 3 contacts and presses the elastic roller 6 via the fixing belt 1 to form the fixing nip N. The inner circumference surface of the fixing belt 1 contacts and slides on the nip formation pad 3. A sheet member may be sandwiched between the nip formation pad 3 and the fixing belt 1 to reduce friction between the nip formation pad 3 and the fixing belt 1. A thermal conduction aid made of metal with high thermal conduction may be attached on a surface of the nip formation pad 3 in the side of the fixing belt 1 to enhance heat transfer in the width direction of the fixing belt 1.

A stay 4 is disposed on the nip formation pad 3 on the side opposite to the fixing nip N to support the nip formation pad 3. The stay 4 prevents bending of the nip formation pad 3 by the elastic roller 6 to keep the nip width uniform in the longitudinal direction. The stay 4 includes three metal plates, that is, a first part 4*a* whose cross-section is like a crossbar (-), a second part 4*b* whose cross-section is like an oblique bar, and a third part 4*c* whose cross-section is L-shaped. The third part 4*c* has a face to support the nip formation pad 3. The holder 2 holds both ends of the three metal plates in the longitudinal direction. In order to increase the rigidity of the stay 4, it is preferable that the cross section of the stay 4 has a large size in a pressing direction that is a crosswise direction in FIG. 1 and a lateral bar shape extending in the pressing direction. However, since the stay 4 having a thin lateral bar shape may be inclined by the pressure when the fixing nip is formed, preferably, the stay 4 supports the nip formation pad 3 at two points, that is, an upstream point and a downstream point in a sheet conveyance direction which is a vertical direction in FIG. 1. However, since a structure having two lateral bars each of which supports each of the upstream point and the downstream point limits a location of the heater 5, the stay 4 has a structure formed by the three parts, that is, a set of the first part like the cross bar and the second part like the oblique bar added the third L-shaped part that gives flatness of the face to support the nip formation pad 3.

A thermal insulation treatment or a specular surface treatment on a surface of the stay 4 reduces unnecessary energy consumption that does not contribute to belt heating due to radiant heat from the heater 5. Instead of such thermal insulation treatment or specular surface treatment, a reflector may be disposed between the heater 5 and the stay 4.

Figure 2A:
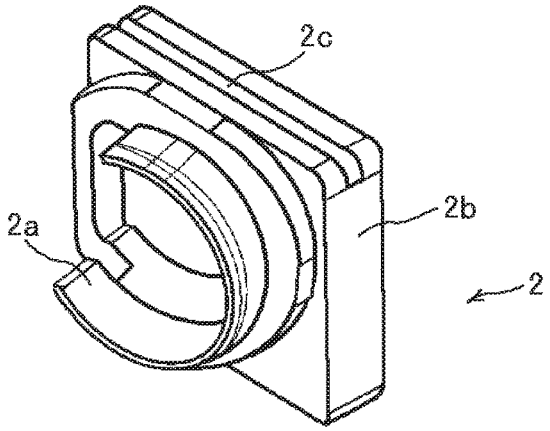
FIG. 2A is a perspective view illustrating a shape of a holder.
Figure 2B:
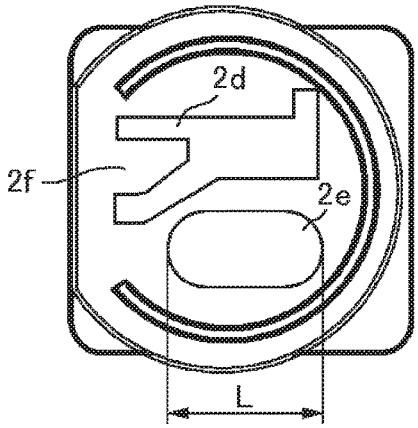
FIG. 2B is a front view of the holder seen from a belt side.
Figure 2C:
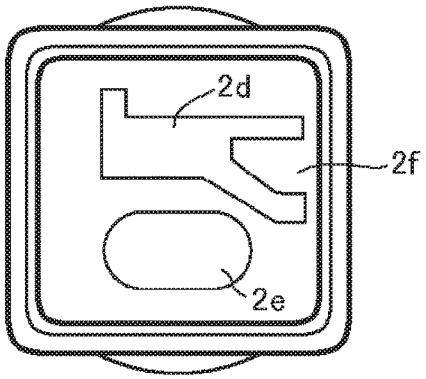
FIG. 2C is a back view of the holder seen from an opposite direction to the belt side.

As illustrated in FIGS. 2A to 2C, the holder 2 includes a belt holder 2*a* and a side plate 2*b*. The holder 2 illustrated in FIG. 2 is disposed at one end of the fixing belt 1 in the width direction, and another holder paired therewith is disposed at the other end of the fixing belt 1.

The belt holder 2*a* protrudes toward the end of the fixing belt 1 and forms a partial cylinder. As seen in FIG. 1, the fixing belt 1 is fitted around the belt holder 2*a*. The belt holder 2*a* limits lateral movement of the fixing belt 1 in the width direction and guides a rotation of the fixing belt 1 in places other than the fixing nip N, when the fixing belt 1 is sandwiched between the elastic roller 6 and the nip formation pad 3 at the fixing nip N and rotated. The side plate 2*b* includes a groove 2*c* in an outer circumferential part, for example, in an upper end face and a lower end face. A side plate of the fixing device 10 falls into the groove 2*c* and supports the holder 2 slidable in the side plate of the fixing device 10.

Additionally, the side plate 2*b* includes a first support portion 2*d* to support a longitudinal end of the stay 4 and a second support portion 2*e* to support the heater 5 movable.

The first support portion 2*d* has a cutout corresponding to the cross section of the stay 4, the longitudinal end of the stay 4 fits into the cutout, and the holder 2 supports the stay 4. A portion 2*f* of the first support portion 2*d* that is not the cutout in a fixing nip side abuts a longitudinal end of the third part 4*c* having the face to support the nip formation pad 3, prevents movement of the stay 4 in the longitudinal direction, and positions the stay 4 in the longitudinal direction.

The second support portion 2*e* is a slot shaped as a rectangle with rounded corners, elongated in a direction in which the holder 2 slides with respect to the side plate of the fixing device 10. The heater 5 is inserted into the second support portion 2*e* from the longitudinal direction and is supported. In the illustrated embodiment, the second support portion 2*e* is the slot shaped the rectangle with rounded corners, but the second support portion 2*e* may be a general rectangular shape, an elliptical shape, or a polygonal shape as long as the second support portion 2*e* limits movement of the heater in the sheet conveyance direction.

Figure 3:
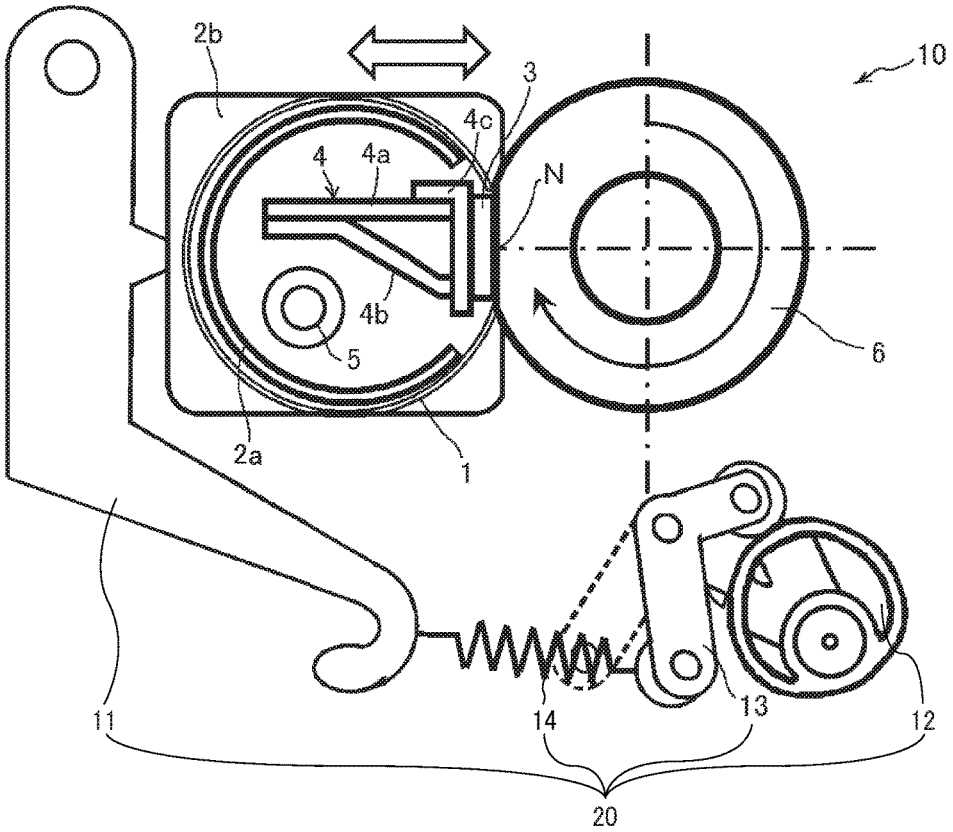
FIG. 3 is a schematic diagram illustrating a mechanism to attach and detach a fixing belt with respect to an elastic roller.

FIG. 3 illustrates an example of a contact-separation mechanism 20 in which the fixing belt 1 and the nip formation pad 3 can press the elastic roller 6 in a releasable manner. The contact-separation mechanism 20 includes a first pressing lever 11 to press the holder 2 toward the fixing nip, a press and release cam 12, a second pressing lever 13 that includes a roller at each of both ends and is pivoted by the press and release cam 12, and a pressure spring 14 each end of which is attached to the first pressing lever 11 and the second pressing lever 13. A rotation of the press and release cam 12 pivots the first pressing lever 11 whose end is fixed and supported by the side plate of the fixing device 10 to slide the holder 2 that is coupled with the first pressing lever 11.

Figure 4A:
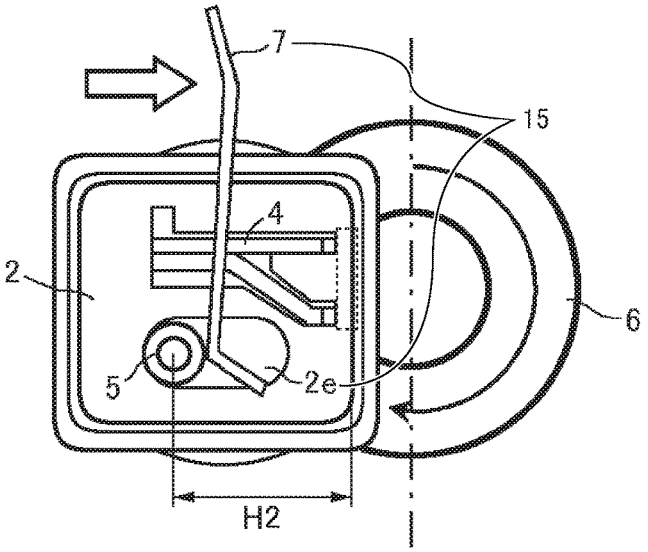
FIG. 4A is a schematic diagram illustrating a physical relationship between a heater and the holder when the holder slides to form a fixing nip.
Figure 4B:
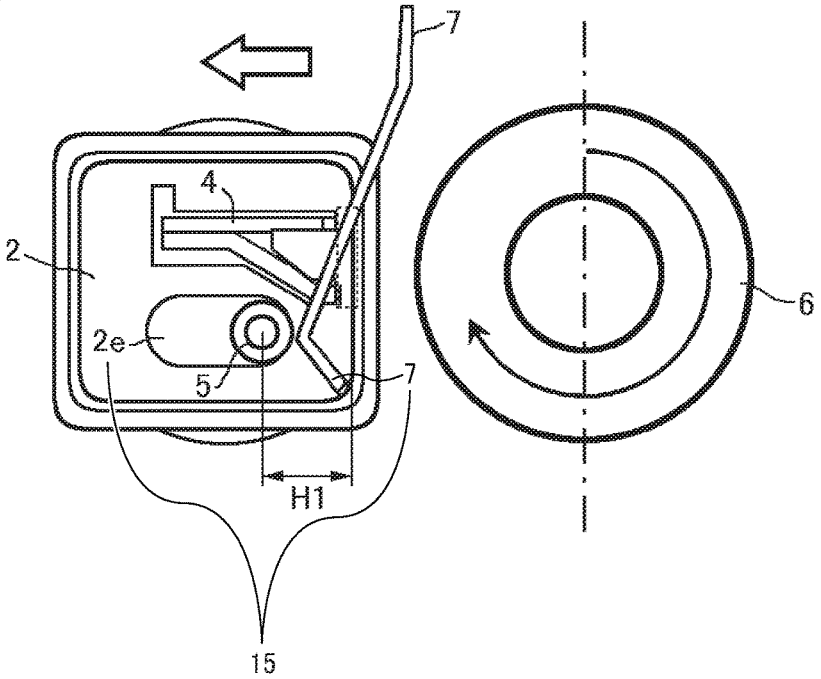
FIG. 4B is a schematic diagram illustrating a physical relationship between the heater and the holder when the holder slides to a release position.
Figure 5:
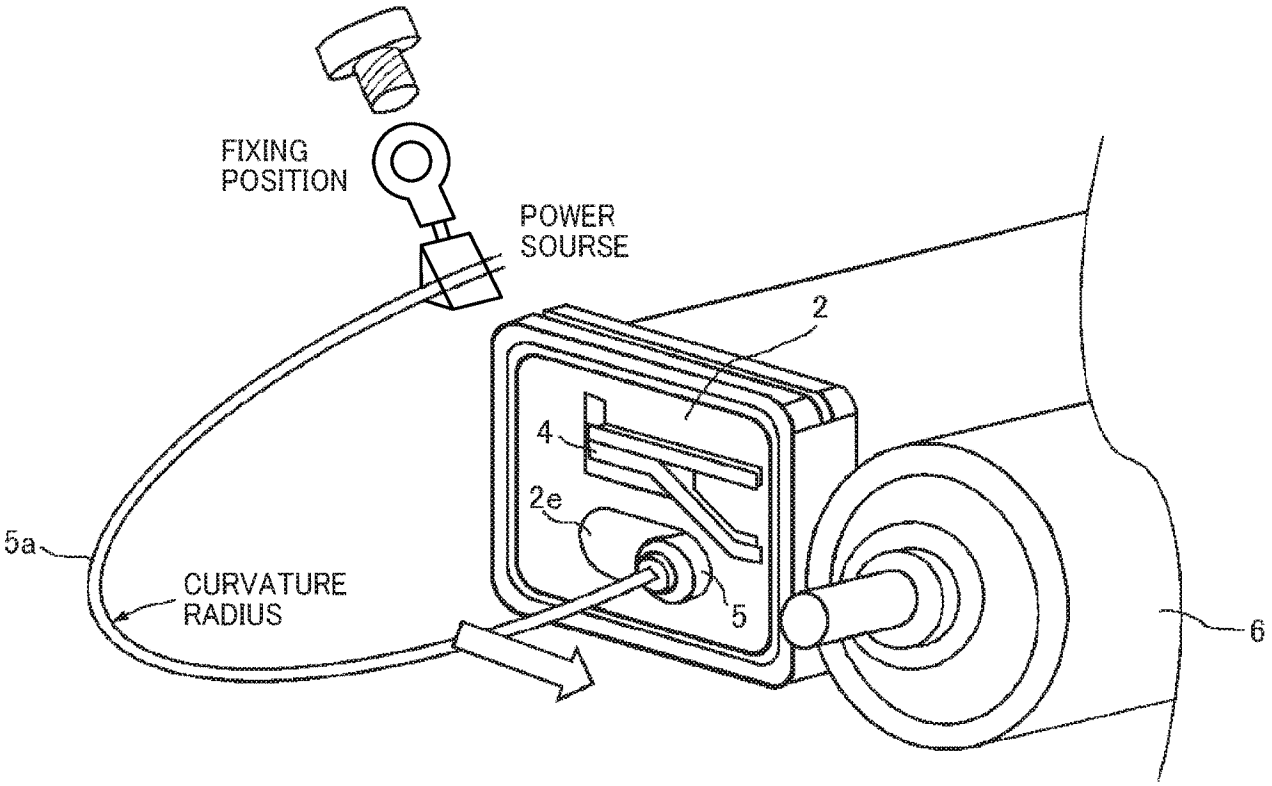
FIG. 5 is an explanatory diagram illustrating a situation in which a force caused by a bent harness that goes back straight presses the heater to the elastic roller.
Figure 6:
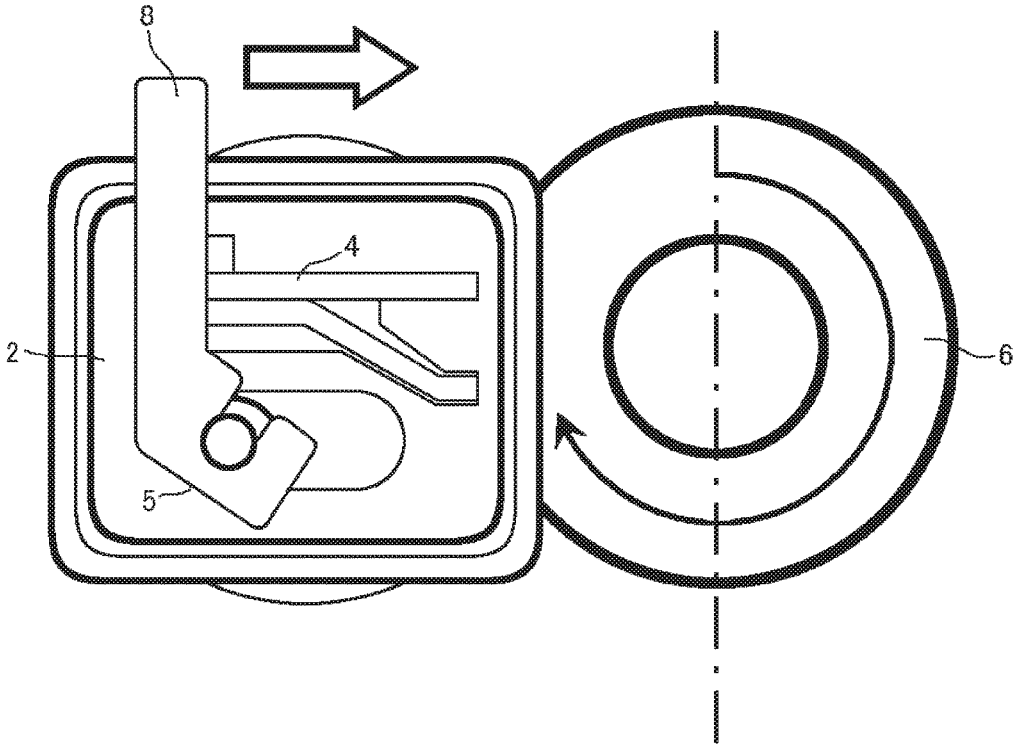
FIG. 6 is a schematic diagram illustrating a structure in which a stopper fixes a position of the heater.

With reference to FIGS. 4A, 4B, and FIG. 5, insertion of the heater 5 in the second support portion 2*e* inserted into the second support portion 2*e* of the holder 2 when the holder 2 slides in a direction orthogonal to the sheet conveyance direction to form the fixing nip and be released is described. A pressing member 7 that constitutes, with the second support portion 2*e* of the holder 2, an adjustment mechanism 15 relating to the movement of the heater 5 is a narrow plate-shaped member or a strip-shaped member fixed to the side plate of either of the fixing device 10 or the image forming apparatus 100 and disposed between the fixing nip and the end of the heater 5 and outside from each of the holders 2 in the longitudinal direction of the stay 4. A position of the pressing member 7 with respect to the side plate of the fixing device 10 or the image forming apparatus 100 does not change when the holder 2 slides. A length L of the slot as the second support portion 2*e* in a direction in which the holder 2 slides, illustrated in FIG. 2B, is set as follows. The length L is set such that, when the holder 2 is in a nip formation position illustrated in FIG. 4A, the heater 5 contacts an end portion of the second support portion 2*e* in the opposite side of the fixing nip, further displaces to the fixing nip side, leads the pressing member 7 to deform elastically, and is limited to move by a force due to the pressing member 7. The length L is also set such that, when the holder 2 move to a release position illustrated in FIG. 4B, the end portion of the second support portion 2*e* in the fixing nip side press the heater 5, which eliminates elastic deformation of the pressing member 7, and the heater 5 gently touches the pressing member 7 or the heater 5 slightly depart from the pressing member 7. As a result, as seen from a comparison between FIGS. 4A and 4B, a distance H2 between the heater 5 and the nip formation pad 3 when the holder 2 is in the nip formation position is larger than the distance H1 between the heater 5 and the nip formation pad 3 when the holder 2 is in the release position. Additionally, the heater 5 is positioned with respect to the nip formation pad 3 and secured not to contact parts near the heater 5 when the holder 2 is in the nip formation position and the release position.

As illustrate in FIG. 5, a harness 5*a* to supply electric power protrudes from an end of the heater 5, is bent with a certain radius of curvature toward the opposite side of the elastic roller 6, and fixed on the side plate of the device in the opposite side of the fixing nip. Since the harness 5*a* includes, for example, electrical leads having a diameter of 2 mm and an insulated tube with 0.4 mm thick surrounding the electrical leads, and has a predetermined rigidity. As a result, a force that returns the harness 5*a* to a straight line is applied to the end of the heater 5. When the holder 2 is in the nip formation position, the heater 5 keep a predetermined gap from the nip formation pad 3 and get a position not to contact the fixing belt 1. On the other hand, when the holder 2 moves to the release position, the force that returns the harness 5*a* to the straight line causes the heater 5 to contact the end portion of the second support portion 2*e* of the holder 2 in the nip side and not to follow the movement of the holder 2 to the release position, and the heater 5 gets a position not to contact the stay 4. When the holder 2 is in the release position, the heater 5 gently touches the pressing member 7 or the heater 5 slightly depart from the pressing member 7, and load between the sealing part of the heater 5 and the harness 5*a* of the heater 5 is very small.

As long as the heater 5 gets the position not to contact the stay 4 and the fixing belt 1 when the holder 2 moves to the release position, the heater 5 may not necessarily be supported movable in the loop formed by the fixing belt 1 when the heater 5 moves in the second support portion 2*e* of the holder 2. Instead of the pressing member 7 that is the elastic narrow plate-shaped member or the elastic strip-like member, a stopper 8 may be used to fix and support the heater 5 at a predetermined position. That is, the heater may not move with respect to the elastic roller 6 if it is possible for the heater 5 to get a relative positional relation for the nip formation pad 3 and the stay 4 in the loop formed by the fixing belt 1 such that the heater keeps a gap greater than a necessary distance with respect to the fixing belt 1 and the nip formation pad 3 when the fixing belt 1 and the nip formation pad 3 press the elastic roller 6 and does not contact the stay 4 and the fixing belt 1 when the holder 2 is in the release position. As a result, the load between the sealing part of the heater 5 and the harness 5*a* is not caused by the movement of the heater 5. In this case, since the stopper 8 is not elastically deformed like the pressing member 7, the end portion of the second support portion 2*e* of the holder 2 in the opposite side of the fixing nip is extended longer from the fixing nip than the one in the embodiment of the pressing member 7.

The structure of the stay 4 having the set of the first part like the cross bar and the second part like the oblique bar to support the nip formation pad 3 at the upstream point and the downstream point in the sheet conveyance direction generates a space that is not used in the opposite side of the fixing nip from the stay 4 because the heater 5 is set not to contact the stay 4 when the holder 2 is in the release position in the embodiment which fix the position of the heater 5 similar to the other embodiment. A variation of the holder 2 that effectively uses such space and a mechanism corresponding to the variation to support and move the heater is described below. This structure also reduces the risk of damage to the sealing part of the heater 5.

Figure 7B:
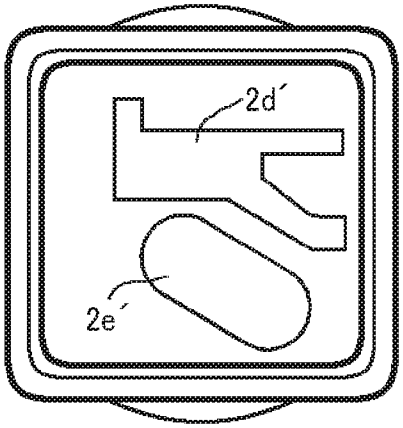
FIG. 7B is a back view of the variation of the holder seen from the opposite direction to the belt side.
Figure 7A:
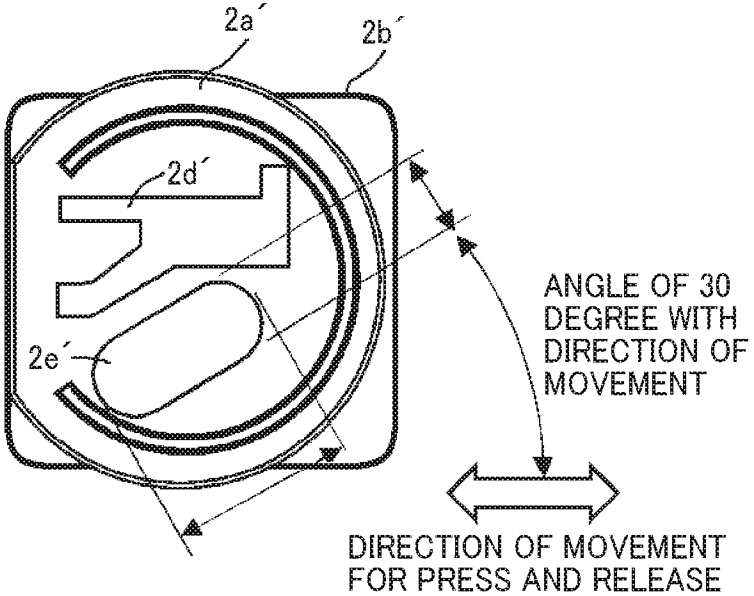
FIG. 7A is a front view illustrating a variation of the holder illustrated in FIG. 2 seen from the belt side.

As illustrated in FIG. 7, the holder 2' as the holder 2 illustrated in FIG. 2 includes a belt holder 2*a*' and a side plate 2*b*'. The side plate 2*b*' includes a slot formed in an upper end face and a lower end face. A side plate of the fixing device 10 falls into the slot and supports the holder 2. A first support portion 2*d*' of the side plate 2*b*' has a slot corresponding to the cross section of the stay 4 as is the case with the holder 2 illustrated in FIG. 2. On the other hand, a second support portion 2*e*' for the heater 5 is a slot shaped as a rectangle with rounded corners that is inclined, for example, 30 degrees to the sliding direction of the holder 2 when the holder 2 moves between the nip formation position and the release position. A side close to the fixing nip becomes the upstream side of the sheet conveyance direction, that is, a low position. The inclination of the second support portion 2*e*' corresponds to the inclination of the oblique bar of the second part of the stay 4, and the second support portion 2*e*' may be a general rectangular shape.

Figure 8A:
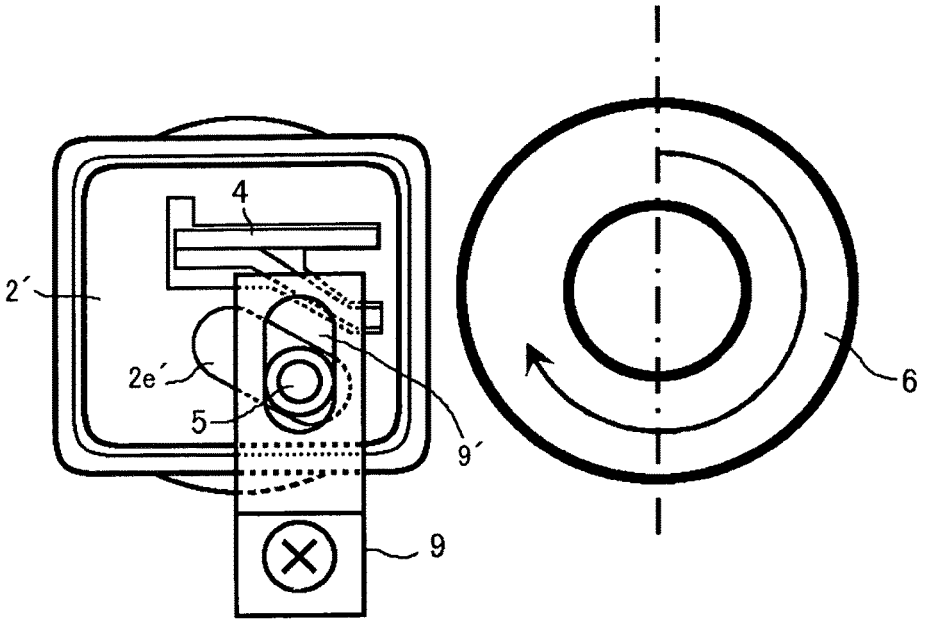
FIGS. 8A, 8B, and 8C are schematic diagrams illustrating a mechanism to support and move the heater with respect to the holder.
Figure 8B:
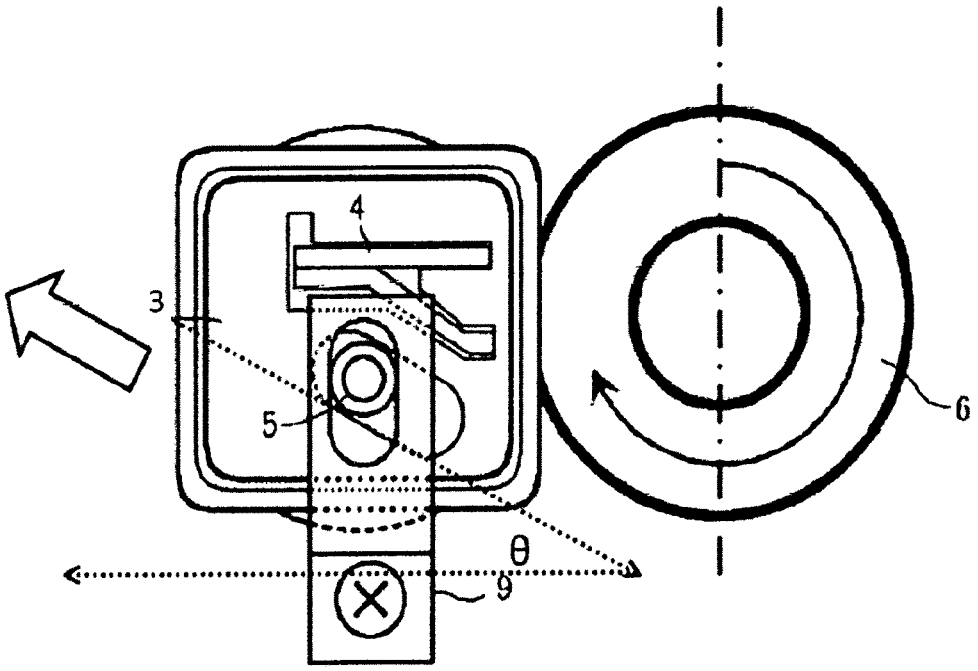

The mechanism in the present variation to support and move the heater 5 is a regulator 9 that sets limits of positions of the heater 5 in a direction in which the fixing belt 1 and the nip formation pad 3 moves to press and release the elastic roller 6 in FIG. 8. The regulator 9 includes a sheet metal part having an elongate hole 9' extending in the sheet conveyance direction that is a vertical direction in FIGS. 8A and 8B to support the heater 5. In common with the holders 2', the regulators 9 are disposed at outsides of the holders 2' disposed at both sides of the fixing belt 1 in the width direction and fixed on the side plates of the device such that positions of the regulators 9 do not change when the fixing belt 1 and the nip formation pad 3 move to press and release the elastic roller 6. With reference to FIG. 8A, when the holder 2' is in the release position, the regulator 9 sets the limits of the position of the heater 5 in a direction orthogonal to the sheet conveyance direction, that is, a horizontal direction in FIG. 8A and moves the heater 5 to position a lower side of the second support portion 2*e*' of the holder 2'. With reference to FIG. 8B, when the holder 2' slides from the release position to the nip formation position, sliding the holder 2' moves the stay 4 and the nip formation pad 3 together, but the heater 5 does not move in the horizontal direction that is a direction in which the fixing belt 1 and the nip formation pad 3 press the elastic roller 6. The heater 5 climbs an inclined part of the second support portion 2*e*' of the holder 2' and moves upward. Such vertical movement of the heater 5 prevents contact between the heater 5 and parts disposed near the heater 5. The hole 9' of the regulator 9 in FIG. 8 is the elongate hole extending in the sheet conveyance direction, but may be somewhat inclined with respect to the sheet conveyance direction. The hole 9' of the regulator 9 in FIG. 8 sandwiches both sides of the ends of the heater 5 in the direction orthogonal to the sheet conveyance direction. However, the hole 9' may be extended in the horizontal direction in FIG. 8 such that the ends of the heater 5 is abutted to the periphery of the hole 9' by the force that returns the harness 5*a* to the straight line.

Figure 8C:
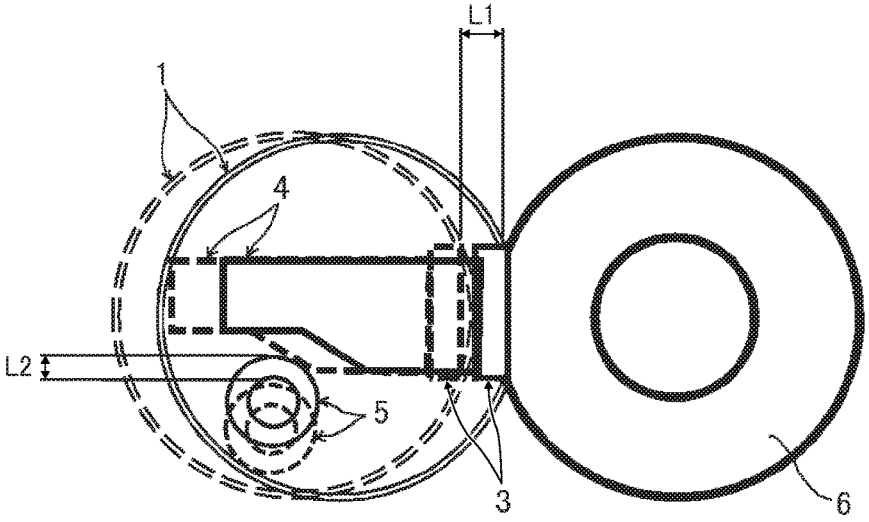

With reference to FIG. 8C, using a movement amount of the nip formation pad 3 L1, a movement amount of heater 5 L2 becomes L2=L1×tan θ wherein θ is the angle formed by the sliding direction of the holder 2 when the holder 2 moves between the nip formation position and the release position (that is, the direction orthogonal to the sheet conveyance direction) and an inclined surface of the second support portion 2*e*' of the holder 2', which is 30 degrees in the present variation described above. Therefore, L2 becomes smaller than L1, that is, the movement amount of the heater 5 can be made smaller than the movement amount of the nip formation pad 3.

In a conventional configuration in which the nip formation pad and the heater are integrally moved, the movement of the heater applies a considerable load between the heater and the heater harness. Reducing the movement amount of the heater 5 accompanying the slide of the holder 2 in the present embodiment and variations reduces the load between the heater 5 and the heater harness 5*a*. In particular, when the moving direction of the heater is orthogonal to a direction in which the harness 5*a* is bent, the radius of curvature of the harness 5*a* is substantially constant regardless of the slide of the holder 2, and the fluctuation of the force applied to the heater can be reduced.

Experiments were conducted to verify an effect of the present disclosure. The fixing device according to the present embodiment and a comparative fixing device in which the nip formation pad and the heater are integrally moved were provided. In both the fixing devices, the moving amount of the nip formation pad was set to be 2 mm, the movement of the nip formation pad to press and release the elastic roller was repeated, and whether breakage of the heater sealing portion occurred was confirmed. As a result, in the comparative fixing device, the heater sealed portion was broken at 120 thousand times, whereas the heater sealed portion in the present embodiment did not break even at 240 thousand times.

Figure 9:
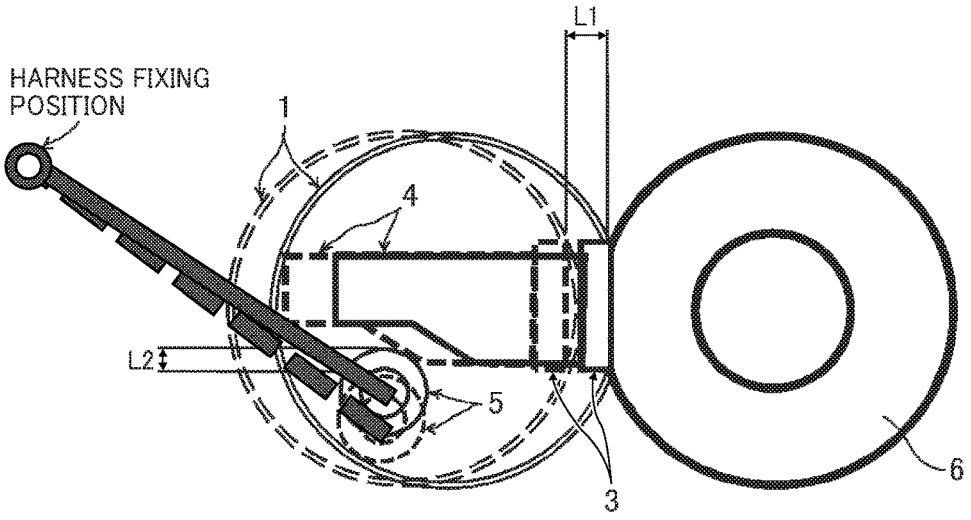
FIG. 9 is a schematic diagram illustrating a configuration of a harness.

FIG. 9 is a schematic diagram illustrating a configuration of the harness. In this configuration, a harness fixing position is set above the heater 5, and when the nip formation pad moves from the nip formation position to the release position, the distance between the harness fixing position and the heater increases. That is, since the radius of curvature of the harness is increased, the force exerted on the heater when the nip formation pad 3 is in the release position becomes small. This improves margin to avoid the breakage of the heater. Table 1 illustrates the radiuses of curvature of the harness (unit: mm) when the nip formation pad presses the elastic roller and when the nip formation pad is released from the elastic roller in each case of the comparative configuration in which the nip formation pad and the heater are integrally moved, a configuration having the mechanism of FIG. 8 to support and move the heater in the harness layout of FIG. 5 (Example 1), and a configuration having the mechanism of FIG. 8 to support and move the heater in the harness layout of FIG. 9 (Example 2).

TABLE 1

| | Radius of curvature of harness (unit: mm) when the nip formation pad presses the elastic roller | Radius of curvature of harness (unit: mm) when the nip formation pad is released from the elastic roller |
|---|---|---|
| Comparative configuration | 25 | 23 |
| Example 1 | 25 | 25 |
| Example 2 | 25 | 26 |

Figure 10:
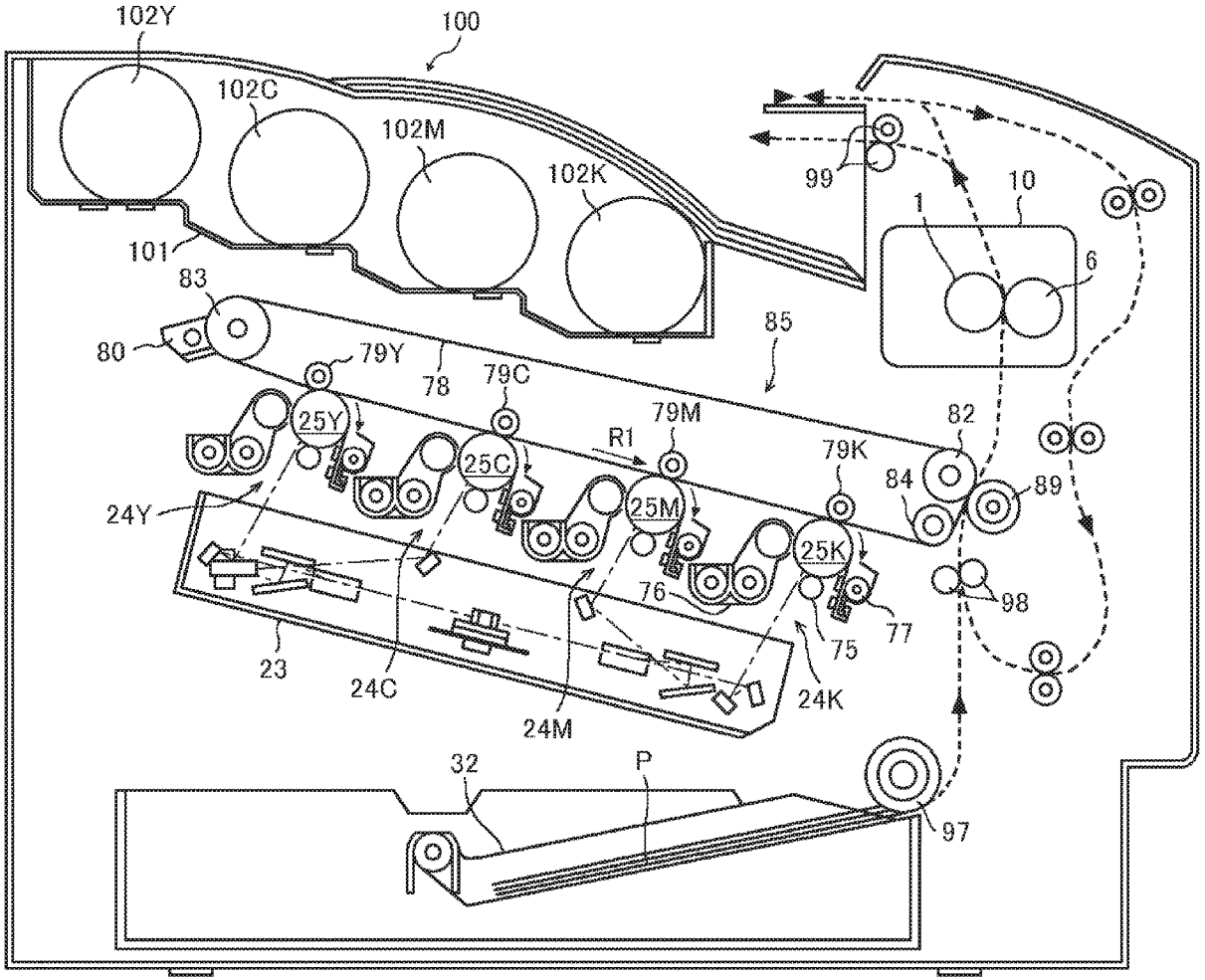
FIG. 10 is a schematic diagram illustrating an image forming apparatus according to an embodiment of the present disclosure.

With reference to FIG. 10, a description is provided of an electrophotographic color printer (hereinafter called as a printer) as an example of an image forming apparatus according to the present embodiment of the present disclosure. As illustrated in FIG. 10, the printer 100 is a color printer employing a tandem system in which a plurality of image forming devices for forming toner images in a plurality of colors, respectively, is aligned in a rotation direction of an intermediate transfer belt.

A bottle housing 101 in an upper portion of a main body of the printer 100 accommodates four toner bottles 102Y, 102C, 102M, and 102K containing fresh yellow, cyan, magenta, and black toners, respectively, and being detachably attached to the bottle housing 101 for replacement. Under the bottle housing, there is provided an intermediate transfer belt unit 85. The image forming devices 24Y, 24C, 24M, and 24K respectively corresponding to yellow, cyan, magenta, and black are arranged in parallel, facing the intermediate transfer belt 78 of the intermediate transfer belt unit 85. The image forming devices 24Y, 24C, 24M, and 24K include photoconductor drums 25Y, 25C, 25M, and 25K, respectively. Each of the photoconductor drums is surrounded by a charger 75, a developing device 76, a cleaner 77, and the like. To illustrate them clearly, reference numerals are assigned only for the black image forming device 24K in FIG. 10.

The image forming devices 24Y, 24C, 24M, and 24K form different single-color images on the respective photoconductor drums 25Y, 25C, 25M, and 25K through a sequence of image forming processes, a charging process, an exposure process, a developing process, and a cleaning process. A drive motor drives and rotates the photoconductor drums 25Y, 25C, 25M, and 25K clockwise in FIG. 10. The charger 75 disposed opposite each of the photoconductor drums 25Y, 25C, 25M, and 25K uniformly charges an outer circumferential surface thereof in the charging process. When the charged outer circumferential surface of each of the photoconductor drums 25Y, 25C, 25M, and 25K reaches an irradiation position where an exposure device 23 is disposed opposite each of the photoconductor drums 25Y, 25C, 25M, and 25K, laser beams emitted from the exposure device 23 irradiate and scan the photoconductor drums 25Y, 25C, 25M, and 25K, thus forming electrostatic latent images according to yellow, magenta, cyan, and black image data in the exposure process. When the scanned outer circumferential surface of each of the photoconductor drums 25Y, 25C, 25M, and 25K reaches a developing position where the developing device 76 is disposed opposite each of the photoconductor drums 25Y, 25C, 25M, and 25K, the developing device 76 develops the electrostatic latent image formed on each of the photoconductor drums 25Y, 25C, 25M, and 25K, thus forming yellow, cyan, magenta, and black toner images on the photoconductor drums in the developing process. When the yellow, cyan, magenta, and black toner images formed on the photoconductor drums 25Y, 25C, 25M, and 25K reach primary transfer nips formed between the photoconductor drums 25Y, 25C, 25M, and 25K and the intermediate transfer belt 78 by four primary transfer bias rollers 79Y, 79C, 79M, and 79K pressed against the four photoconductor drums 25Y, 25C, 25M, and 25K via the intermediate transfer belt 78, respectively, the yellow, magenta, cyan, and black toner images formed on the photoconductor drums 25Y, 25C, 25M, and 25K respectively, are primarily transferred onto the intermediate transfer belt 78 in a primary transfer process. After the primary transfer process, residual toner failed to be transferred onto the intermediate transfer belt 78 remains on the photoconductor drums 25Y, 25C, 25M, and 25K slightly. When the residual toner on each of the photoconductor drums 25Y, 25C, 25M, and 25K reaches a cleaning position where the cleaner 77 is disposed opposite each of the photoconductor drums 25Y, 25C, 25M, and 25K, a cleaning blade of the cleaner 77 mechanically collects the residual toner from each of the photoconductor drums 25Y, 25C, 25M, and 25K in the cleaning process. Finally, when the cleaned outer circumferential surface of each of the photoconductor drums 25Y, 25C, 25M, and 25K reaches a discharging position where the discharger is disposed opposite each of the photoconductor drums 25Y, 25C, 25M, and 25K, the discharger eliminates residual potential from each of the photoconductor drums 25Y, 25C, 25M, and 25K. Thus, a series of image forming processes performed on the photoconductor drums 25Y, 25C, 25M, and 25K is finished.

The toner images formed on the surfaces of the photoconductor drums 25Y, 25C, 25M, and 25K through the developing process are transferred onto the intermediate transfer belt 78 of the intermediate transfer belt unit 85 while being superimposed one atop another to form a color toner image on the intermediate transfer belt 78. The intermediate transfer belt unit 85 includes the intermediate transfer belt 78, the four primary transfer bias rollers 79Y, 79C, 79M, and 79K, a secondary transfer backup roller 82, a cleaning backup roller 83, a tension roller 84, and an intermediate transfer belt cleaner 80.

The intermediate transfer belt 78 is stretched taut across and supported by the three rollers, that is, the secondary transfer backup roller 82, the cleaning backup roller 83, and the tension roller 84. One of the three rollers, that is, the secondary transfer backup roller 82, drives and rotates the intermediate transfer belt 78 in a rotation direction indicated by arrow R1 in FIG. 10. The four primary transfer bias rollers 79Y, 79C, 79M, and 79K sandwich the intermediate transfer belt 78 together with the four photoconductor drums 25Y, 25C, 25M, and 25K, respectively, thus forming the four primary transfer nips between the intermediate transfer belt 78 and the photoconductor drums 25Y, 25C, 25M, and 25K. The primary transfer bias rollers 79Y, 79C, 79M, and 79K are applied with a primary transfer bias having a polarity opposite a polarity of electric charge of toner. The intermediate transfer belt 78 rotates in the direction indicated by the arrow in FIG. 10 and sequentially passes through the respective primary-transfer nips of the primary transfer bias rollers 79Y, 79C, 79M, and 79K, and the toner images are superimposed one on another on the intermediate transfer belt 78, forming a full-color toner image thereon. Then, the intermediate transfer belt 78 carrying the full-color toner image reaches a position facing a secondary transfer roller 89 disposed facing the secondary transfer backup roller 82. The secondary transfer backup roller 82 and the secondary transfer roller 89 press against each other via the intermediate transfer belt 78, and the contact portion therebetween is hereinafter referred to as a secondary transfer nip. The full-color toner image formed by superimposing the yellow, cyan, magenta, and black toner image on the intermediate transfer belt 78 is transferred onto the sheet P serving as a recording medium transported to the secondary transfer nip. At this time, a residual toner, which is not transferred to the sheet P, is left on the intermediate transfer belt 78. When the residual toner on the intermediate transfer belt 78 reaches a cleaning position where the intermediate transfer belt cleaner 80 is disposed opposite the intermediate transfer belt 78, the intermediate transfer belt cleaner 80 collects the residual toner from the intermediate transfer belt 78. After these processes, a series of transfer processes of the intermediate transfer belt 78 is completed.

The sheet P is transported by a sheet feeder 32 provided in the lower portion of the main body of the printer 100 to the secondary transfer nip via a sheet feed roller 97, pairs of conveyance rollers, and a registration roller pair 98. Specifically, multiple sheets P are stacked in the sheet feeder 32. The sheet feed roller 97 rotates counterclockwise in FIG. 10 to feed the sheet P on the top in the sheet feeder 32 toward a nip of the registration roller pair 98. The sheet P conveyed to the registration roller pair 98 temporarily stops and abuts at the roller nip formed between the registration roller pair 98, as the registration roller pair 98 stops rotating. The registration roller pair 98 resume rotation to transport the sheet P to the secondary transfer nip, timed to coincide with the arrival of the full-color toner image on the intermediate transfer belt 78. Thus, a desired full-color toner image is transferred to the sheet P.

Subsequently, the sheet P bearing the full-color toner image is transported to a fixing device 10. In the fixing device 10, a fixing belt 1 and an elastic roller 6 apply heat and pressure to the sheet P to fix the full-color toner image on the sheet P. Thereafter, the sheet P bearing the fixed toner image is ejected by an output roller pair 99 onto an outside of the printer 100. The sheet P ejected by the output roller pair 99 onto the outside of the printer 100 is stacked on an output tray 100 as a print. Thus, a sequence of image forming processes performed in the image forming apparatus is completed.

Numerous additional modifications and variations are possible considering the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

an endless belt;

a pressure rotator configured to contact the endless belt;

a nip formation pad in a loop formed by the endless belt, the nip formation pad configured to form a fixing nip between the endless belt and the pressure rotator when the pressure rotator contacts the endless belt;

a heater in the loop formed by the endless belt, the heater configured to heat the endless belt;

a stay configured to support the nip formation pad;

a contact-separation mechanism configured to press the nip formation pad against the pressure rotator in a releasable manner;

a holder on an outer side in a width direction of the endless belt, the holder configured to limit movement of the endless belt in the width direction and to support the stay, the holder being movable between a nip formation position and a release position, the holder including a slot therein, the heater configured to move within the slot with respect to the holder; and an adjustment mechanism configured to maintain a first distance between the heater and the nip formation pad when the holder is at the nip formation position such that the first distance is larger than a second distance between the heater and the nip formation pad when the holder is at the release position.

2. The fixing device according to claim 1, wherein the slot extends in a direction in which the holder moves between the nip formation position and the release position.

3. The fixing device according to claim 1, wherein a position at which the heater abuts the slot and is supported by the slot when the holder is at the nip formation position is different from a position at which the heater abuts the slot and is supported by the slot when the holder is at the release position.

4. The fixing device according to claim 1, wherein the adjustment mechanism includes a pressing member configured to elastically deform to press the heater to an end of the slot when the holder is at the nip formation position.

5. The fixing device according to claim 4, further comprising:

a harness configured to supply electric power to the heater, the harness being connected to a side plate of the fixing device at a fixing position such that the harness is curved from the heater toward the fixing position.

6. The fixing device according to claim 4, wherein the pressing member is attached to a side plate of the fixing device.

7. The fixing device according to claim 1, wherein the heater is relatively movable with respect to the slot, and wherein the adjustment mechanism includes a stopper configured to fix and support the heater at a set position.

8. The fixing device according to claim 7, wherein the stopper is fixed on a side plate of the fixing device.

9. The fixing device according to claim 1, wherein the slot extends in a direction different from the direction in which the holder moves between the nip formation position and the release position, and wherein the adjustment mechanism includes a regulator configured to support the heater movable in a direction orthogonal to the direction in which the holder moves.

10. An image forming apparatus comprising:

the fixing device according to claim 1.

11. The image forming apparatus according to claim 10, wherein the adjustment mechanism includes a pressing member, the pressing member being attached to a side plate of the fixing device.

12. The image forming apparatus according to claim 10, wherein the adjustment mechanism includes a pressing member, the pressing member being fixed to a side plate of the image forming apparatus.

13. A method of operating a fixing device, the fixing device including an endless belt, a pressure rotator configured to contact the endless belt; a nip formation pad in a loop formed by the endless belt, the nip formation pad configured to form a fixing nip between the endless belt and the pressure rotator when the pressure rotator contacts the endless belt, a heater in the loop formed by the endless belt, the heater configured to heat the endless belt, a stay configured to support the nip formation pad, a contact-separation mechanism configured to press the nip formation pad against the pressure rotator in a releasable manner, a holder on an outer side in a width direction of the endless belt, the holder configured to limit movement of the endless belt in the width direction and to support the stay, the holder being movable between a nip formation position and a release position, the holder including a slot therein, the heater configured to move within the slot with respect to the holder and an adjustment mechanism, the method comprising:

moving the heater within the slot by moving the holder between a nip formation position and a release position such that the heater is separated from the nip formation pad by a first distance when the holder is at the nip formation position and is separated from the nip formation pad by a second distance when the holder is at the release position, the second distance being greater than the first distance, and maintaining, via the adjustment mechanism, the first distance between the heater and the nip formation pad when the holder is at the nip formation position.

14. The method according to claim 13, wherein the moving moves the heater within the slot by moving the holder such that the holder moves in a same direction as the slot extends.

15. The method according to claim 13, wherein the moving moves the heater within the slot by moving the holder such that a position at which the heater abuts the slot and is supported by the slot when the holder is at the nip formation position is different from a position at which the heater abuts the slot and is supported by the slot when the holder is at the release position.

16. The method according to claim 13, wherein the adjustment mechanism includes a pressing member, and the maintaining comprises:

elastically deforming the pressing member when the holder is at the nip forming position such that the pressing member presses the heater towards an end of the slot when the holder is at the nip forming position to maintain the first distance between the heater and the nip formation pad.

* * * * *